US008962962B2

(12) United States Patent
Jones

(10) Patent No.: US 8,962,962 B2
(45) Date of Patent: Feb. 24, 2015

(54) SYSTEM AND APPARATUS FOR ADJUSTING THE TONAL OUTPUT OF A MEMBRANOPHONE

(71) Applicant: Andrew D Jones, Salt Lake City, UT (US)

(72) Inventor: Andrew D Jones, Salt Lake City, UT (US)

( * ) Notice: Subject to any disclaimer, the term of this patent is extended or adjusted under 35 U.S.C. 154(b) by 261 days.

(21) Appl. No.: 13/681,295

(22) Filed: Nov. 19, 2012

(65) Prior Publication Data

US 2013/0125730 A1 May 23, 2013

Related U.S. Application Data

(60) Provisional application No. 61/560,868, filed on Nov. 17, 2011.

(51) Int. Cl.
*G10D 3/00* (2006.01)
*G10D 13/02* (2006.01)

(52) U.S. Cl.
CPC ..... *G10D 13/021* (2013.01); *G10D 13/027* (2013.01)
USPC ..... 84/411 R

(58) Field of Classification Search
CPC ..... G10D 13/02; G10D 13/021; G10D 13/00; G10D 13/027; G10D 13/023; G10D 13/04; G10G 5/005; G10G 5/00; G10G 7/00; G10G 7/005; G10G 7/02
USPC ..... 84/411 R, 419–421, 411 A
See application file for complete search history.

(56) References Cited

U.S. PATENT DOCUMENTS

| | | | | |
|---|---|---|---|---|
| 1,877,871 | A * | 9/1932 | Hoffman | 84/420 |
| 4,899,635 | A | 2/1990 | Santangelo | |
| 5,349,891 | A | 9/1994 | Belli | |
| 5,461,959 | A | 10/1995 | Sassmannshausen et al. | |
| 5,877,440 | A | 3/1999 | Chaffee et al. | |
| 5,920,021 | A | 7/1999 | Good | |
| 5,986,197 | A | 11/1999 | Allen | |
| 6,483,017 | B1 | 11/2002 | Dill et al. | |
| 6,525,259 | B2 | 2/2003 | Sagastegui | |
| 6,580,023 | B2 | 6/2003 | Belli | |
| 6,667,432 | B2 | 12/2003 | Brando | |
| 6,686,526 | B2 | 2/2004 | Ezbicki | |
| 6,696,630 | B2 | 2/2004 | Gatzen | |
| 6,909,040 | B1 * | 6/2005 | Fredrickson et al. | 84/411 R |
| 7,074,994 | B2 | 7/2006 | Belli | |
| 7,488,882 | B2 | 2/2009 | Curet Troche | |
| 7,659,469 | B2 | 2/2010 | Belli | |
| 8,247,678 | B1 | 8/2012 | Ivy | |
| 2002/0005106 | A1 | 1/2002 | Payerl | |

* cited by examiner

*Primary Examiner* — Kimberly Lockett
(74) *Attorney, Agent, or Firm* — Geoffrey E. Dobbin; Dobbin IP Law P.C.

(57) ABSTRACT

The present invention is a system for modifying the tonal output of a hand drum. The system includes the use of a tonal cover or membrane to change the sound emitted when the head of a hand drum is struck. Additional tuning pads are then added to further modify the sound of the drum. Tonal adjustment is affected by the number, thickness, material and tautness of the additional pads and tonal cover. A partial coverage of the drum head by a tonal cover may also be utilized.

14 Claims, 5 Drawing Sheets

SYSTEM AND APPARATUS FOR ADJUSTING THE TONAL OUTPUT OF A MEMBRANOPHONE

CROSS-REFERENCES TO RELATED APPLICATIONS

This Application claims priority as a non-provisional perfection of prior filed U.S. provisional application 61/560,868, filed Nov. 17, 2011, and incorporates the same by reference in its entirety.

FIELD OF THE INVENTION

The present invention relates to the field of percussion instruments and more particularly relates to a system whereby the tonal output of a membranophone, such as a hand drum, is adjusted to match the desires of a player.

BACKGROUND OF THE INVENTION

Membranophones, or drums, are perhaps the first instruments ever used by mankind. For ages, they have been used to communicate and "keep the beat" in musical performances and ceremonies. Despite their relatively simplistic construction, many varieties of drums have been developed. Among these varieties of drums is what is usually called "hand drums." A hand drum a percussive musical instrument consisting of a resonating chamber and membrane stretched over one or both ends of the resonating chamber, played primarily (but not exclusively) with bare hands. This classification of percussion instrument includes, but is not limited to, the following drums: the djembe, conga, dunun, bugarabu, dumbek, darbuka, and the bata. Each hand drum has its own tonal qualities; based upon its type, construction, dimensions and tuning. These tonal sounds are typically categorized as bass, tone, and slap. Variation of those qualities for a particular drum has, to this point, been limited to: the manner in which the membrane, or drum head, is struck; the tension applied to the drum head; and modifications made to the body of the drum. As a result, different drums are usually required to create different sounds. This limitation is present in all types of percussion instruments and is still seen today, where the percussion section of orchestras, bands and other ensembles has a plethora of different drums, all operated by one or more individuals and, in some cases, a given drum is only used for one song, or even a portion of one song.

To obtain different sounds from a single drum, three strategies may be employed. In the first, a drum would have to be re-tuned by tightening or loosening the tension mechanism of the drum or by incorporating a separate tension modifying mechanism. Sounds obtained by this re-tuning method are, however, still limited by the other qualities of the drum. Additional drums are still needed to obtain sounds beyond the capabilities and tuning of a given drum. Secondly, and in order to obtain a totally different sound, the drum head could be removed entirely and replaced with a different drum head. The third strategy involves permanently modifying the shape of the drum itself. These strategies modify the instrument as the drum head is intended to be a semi-permanent part of the drum and the drum body is permanent. They are time consuming. Also, animal skin drum heads are typically no longer usable after they are removed, so this strategy is not for temporary changes and quickly becomes cost prohibitive. Simply obtaining a different drum is generally much easier than total removal and re-installation of a drum head and is less wasteful and expensive.

The present invention is a system that will adjust the tonal qualities of any membranophone without any modification to the instrument itself and has particular use with hand drums. In so doing, fewer drums may be required in order to create a given range of sounds. Thus, the present invention reduces the initial cost of outlay in order to create a desired arsenal of percussive instruments. The present invention also allows a given drum to emanate different sounds, including imitating a sound from another kind of drum. The present invention also provides a degree of protection to a drum and allows use of a drum in inclement weather, which can damage natural skin and materials used in any membranophone, and with hand drums in particular.

The present invention represents a departure from the prior art in that the system of the present invention allows for the adjustment of a drum's tonal qualities by layering a plurality of covers over the drum head in a calculated manner to modify the drum's original tone. Prior art covers were used primarily for protection or for the purpose of muting the sound of a drum entirely. Changing tonal qualities of the drum, such as pitch, length of sound wave decay and the presence of overtones, has been previously accomplished by changing the tension of the drum head. The system according to the present invention does not mute the sound, but instead imparts a different and desired tonal quality to the sound emitted by a given drum by altering pitch, resonation decay, and overtone of the drum head and in the resonation chamber and is adjustable according to the desires of the player without modifying the instrument itself. It also performs these tasks without modifying the actual instrument.

SUMMARY OF THE INVENTION

In view of the foregoing disadvantages inherent in the known types of hand drums, this invention provides a tonal adjustment system for hand drums. As such, the present invention's general purpose is to provide a new and improved tonal adjustment system that is easy to implement and cost-effective without requiring actual modification of the instrument itself.

To accomplish these objectives, the system comprises at least one tonal cover. The tonal cover also comprises an attachment mechanism. The tonal cover covers the drum head in full or in part and is struck by the player to produce the modified tone. It may be made of any suitable material, including leather, skin, vinyl, rubber or cloth. The attachment mechanism may be any structure that could be used to temporarily attach the cover to the drum, and may be a tie system inherent in the cover, or an added elastic or non-elastic cord. Various pieces of hardware may also be used to fasten the cover to the drum. Additionally, at least one extra tuning pad may be added between the tonal cover and the drum head. The tuning pad may be the same or a different material than the tonal cover and could even be an additional tonal cover.

Other benefits are derived from the use of the present invention. The present invention also provides protection to the drum head and drum body. It can also be used as a handle with which to pick up and carry the drum or, if present, securement cords can be used as a storage system for percussive accessories. Finally, the tonal cover is also used as a cushion to enhance player comfort in using the drum.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the system is herein described. It should be noted that the articles "a", "an", and "the", as used in this specification, include plural referents unless the content clearly dictates otherwise.

Figure 1:
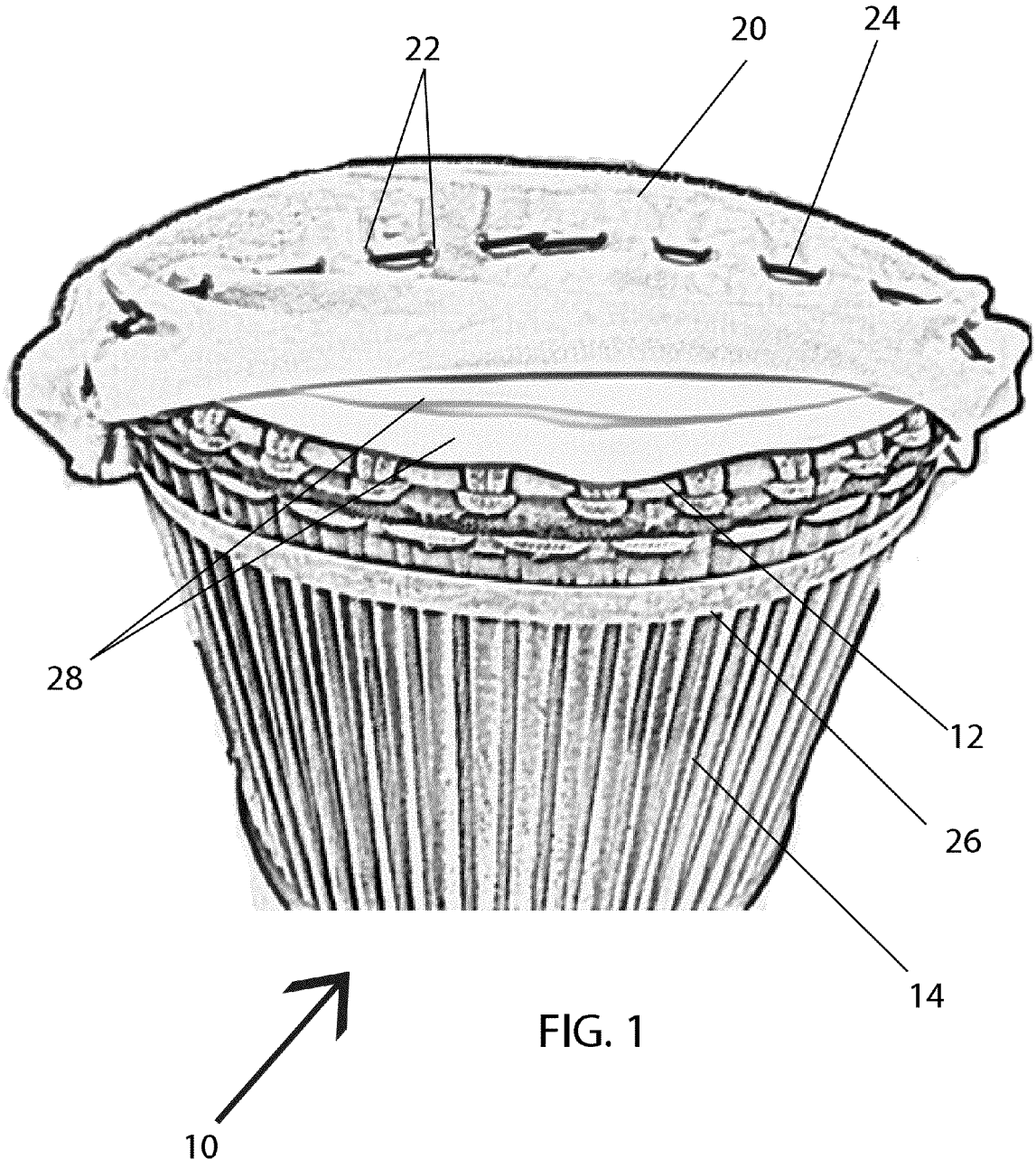
FIG. 1 is a first embodiment of a system according to the present invention.
Figure 2:
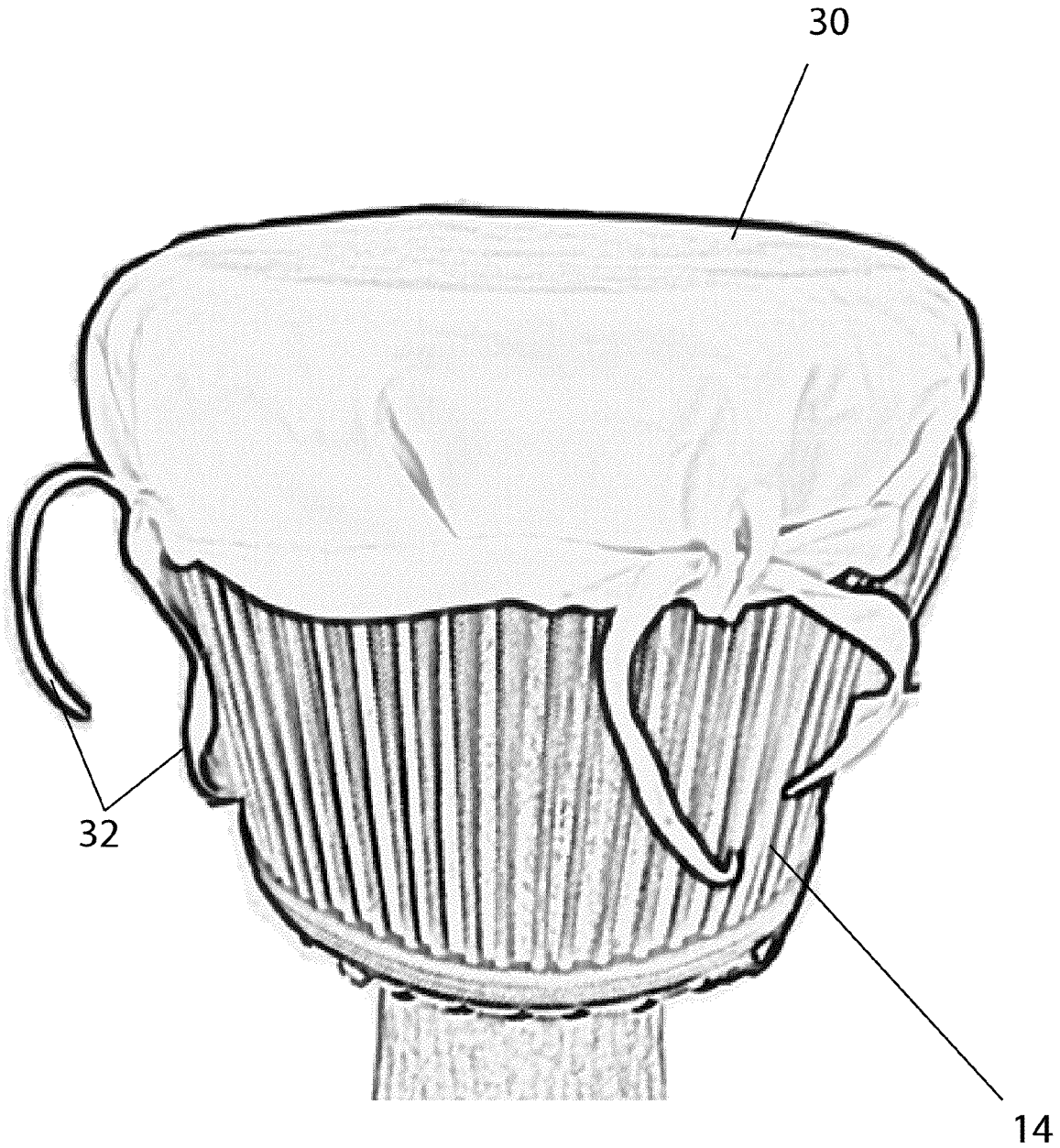
FIG. 2 is a second embodiment of a system according to the present invention.

With reference to FIG. 1, a hand drum 10, in this case a djembe, is fitted with at least one tonal cover 20. The system comprises at least one membrane or tonal cover 20 that is layered upon the drum head 12. The tonal cover 20 is secured about the resonation chamber 14, which may be done by many different methods. In FIG. 1, tonal cover 20 is fitted with grommets 22 through which an elastic drawstring 24 is threaded. The tonal cover 20 is simply positioned over the drum head 12 and the drawstring 24 tightened to secure the tonal cover 20. An additional elastic band 26 may also be added as a friction providing zone to further aid in keeping the tonal cover 20 in place. The elastic band 26 may also be used as a securement means, in particular for additional tuning layers 28 which may be added to the system. In FIG. 2, the tonal cover 30 is fashioned with tie strips 32 which may be used to secure the tonal cover 20 to the drum resonation chamber 14.

The use of a single layer, such as with the use of just a single tonal cover, tends to modify the tonal output of the membranophone by lowering the pitch of the open tone and open slap, by modifying the overtones produced, and by increasing the decay of the open tone sound frequencies, without modifying the pitch or volume of the bass note. The degree to which the tonal output of the drum is modified is determined by the composition and configuration of materials used. Thicker, or additional, layers increase the degree to which the pitch is lowered, the overtones modified, and decay increased. Other factors in tonal modification include the density, flexibility and porousness of the material used, and the portion of the drum head that is covered by the tonal cover(s).

Additional layers may be added to further adjust the output sound. These additional tuning layers may be in the form of an additional cover or through the use of tuning pads that are added to the system. Pads may be inserted between the drum head and the tonal cover by simply removing the cover, positioning the pad(s), and replacing the cover. Additional covers further adjust the sound qualities of the drum depending upon the number, thickness, material, etc. of the tuning layers. For ease of use, the securement system must be easily unfastened and refastened so that pad may be quickly added or removed as needed. The tonal cover 20 and tuning layers 28 may be made of any material that would make an appropriate membrane. These materials include animal skins, similar to those used in the construction of hand drums, and rubber, vinyl, and other elastomers. Animal skins are preferred as they are familiar to the users of hand drums (the perceived majority of the users of this invention).

Ultimately, the total change in tone is dependent upon the thickness of the composite membrane layer (original drum head plus tonal covers). As an example, a cow skin tonal cover would have an average thickness of 0.95 to 1.20 mm. Adding one cow skin tonal cover to a djembe drum with a natural pitch of G lowers the pitch by 2.5 steps to a D♯. A second cover further lowers the pitch by 1.5 steps to a C. Adding a third cover lowers the pitch by another 1.5 steps to an A♯. A fourth cover only lowers the pitch by one step to a G♯ while a fifth lowers by a further 0.5 step to a G, a full octave below the starting pitch. Thinner layers (such as goat, sheep or pig skin) may be used in multiple layers in order to fine tune a membranophone to a desired pitch, especially with the initial layers which cause larger adjustments in pitch. It should be noted that, since total change in pitch is dependent upon total thickness of the composite membrane layer, the addition of two 0.5 mm goat skins will have the same impact as one 1.0 mm cow skin.

Figure 3:
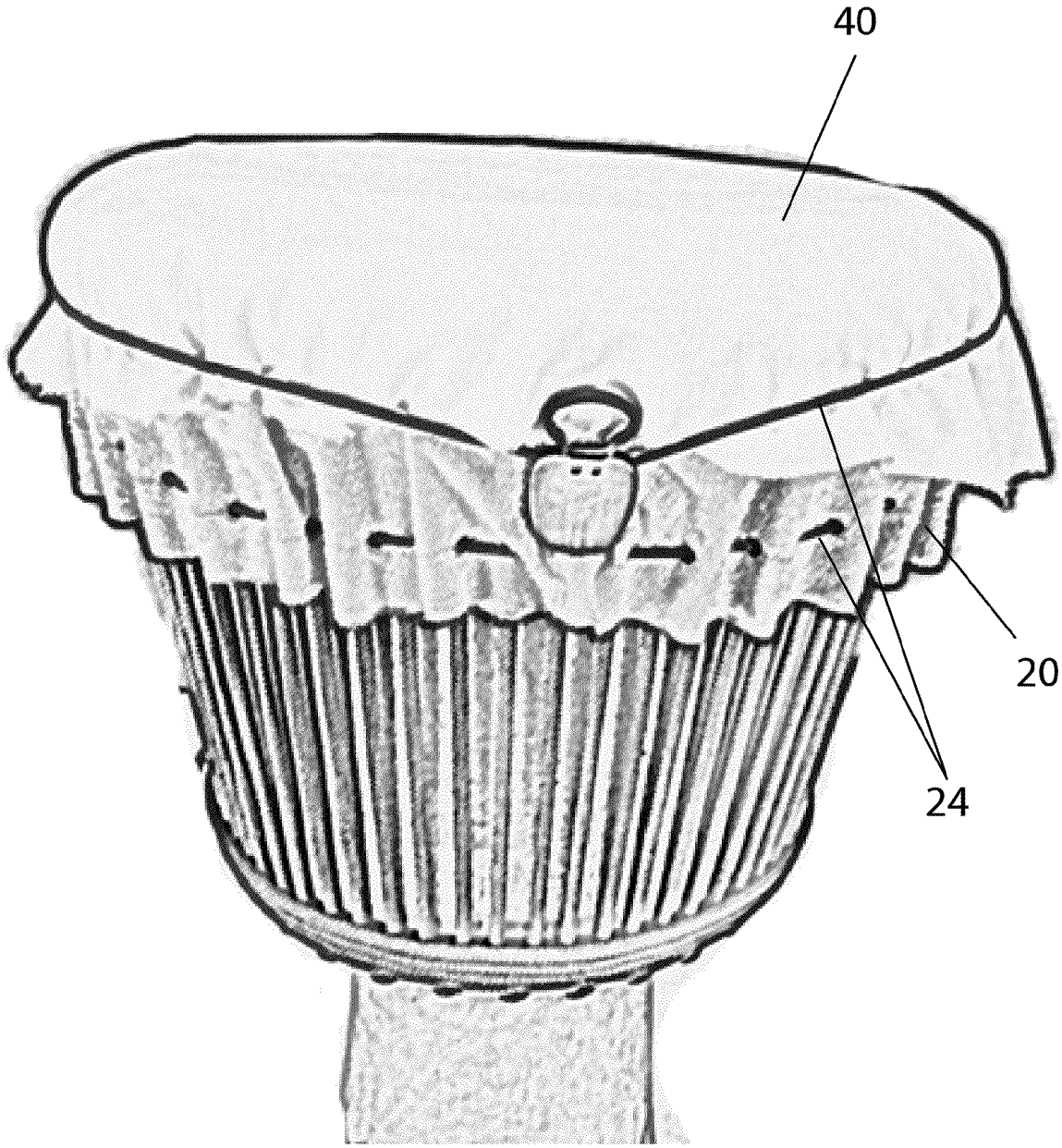
FIG. 3 is a third embodiment of a system according to the present invention.
Figure 4:
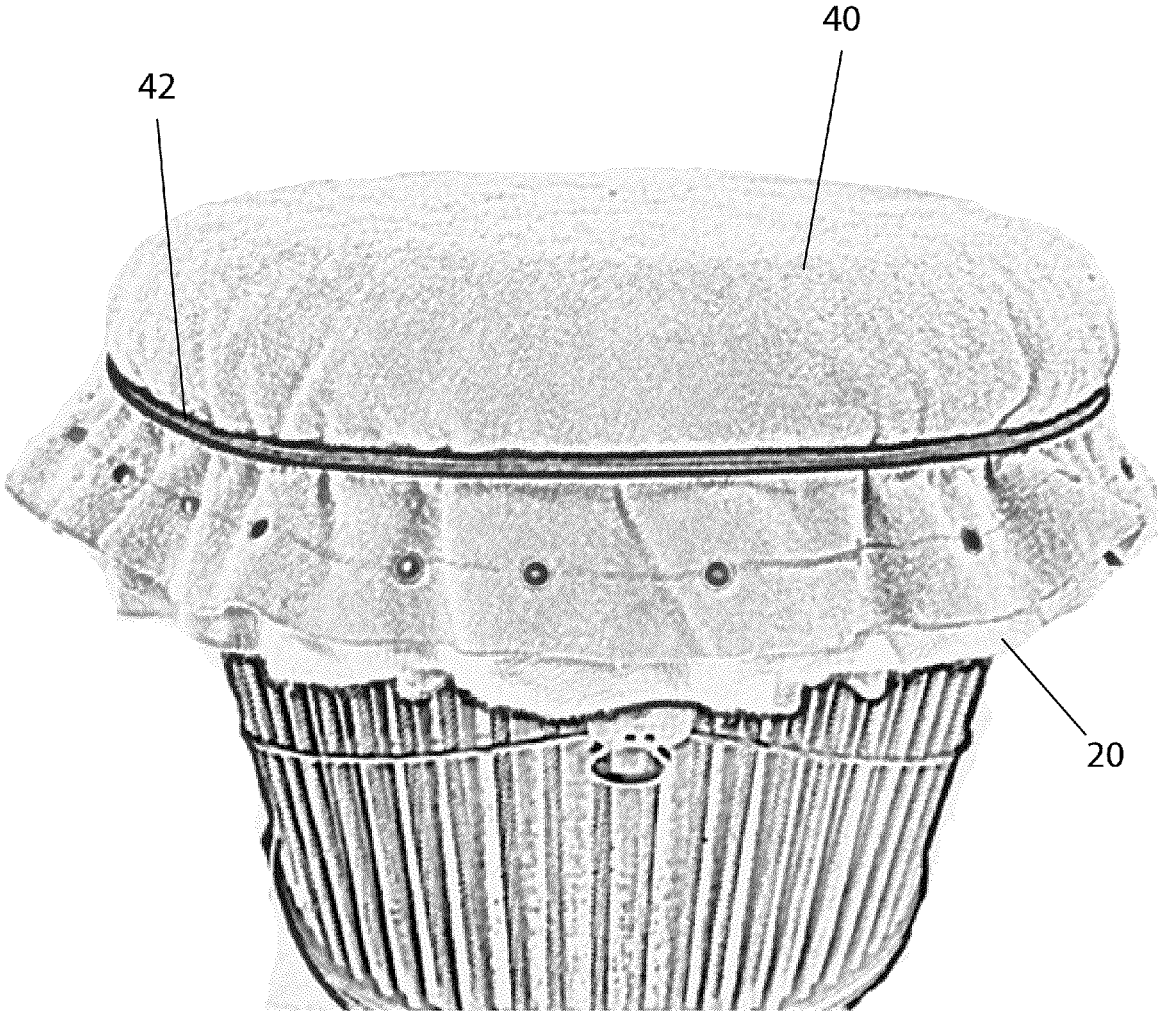
FIG. 4 is a fourth embodiment of a system according to the present invention.

It should be noted that a tuning layer may be in the form of an additional tonal cover 40 (FIG. 3) which is secured over a first tonal cover 20. In the depicted arrangement, the extra tonal cover 40 is actually secured with the same elastic drawstring 24 as the original cover 20. In FIG. 4, the additional tonal cover 40 is secured by its own elastic band 42. It should be noted that any means that would temporarily secure the cover to the drum will suffice. Other structures that could be used to secure the tonal cover to the drum include snaps and VELCRO.

Figure 5:
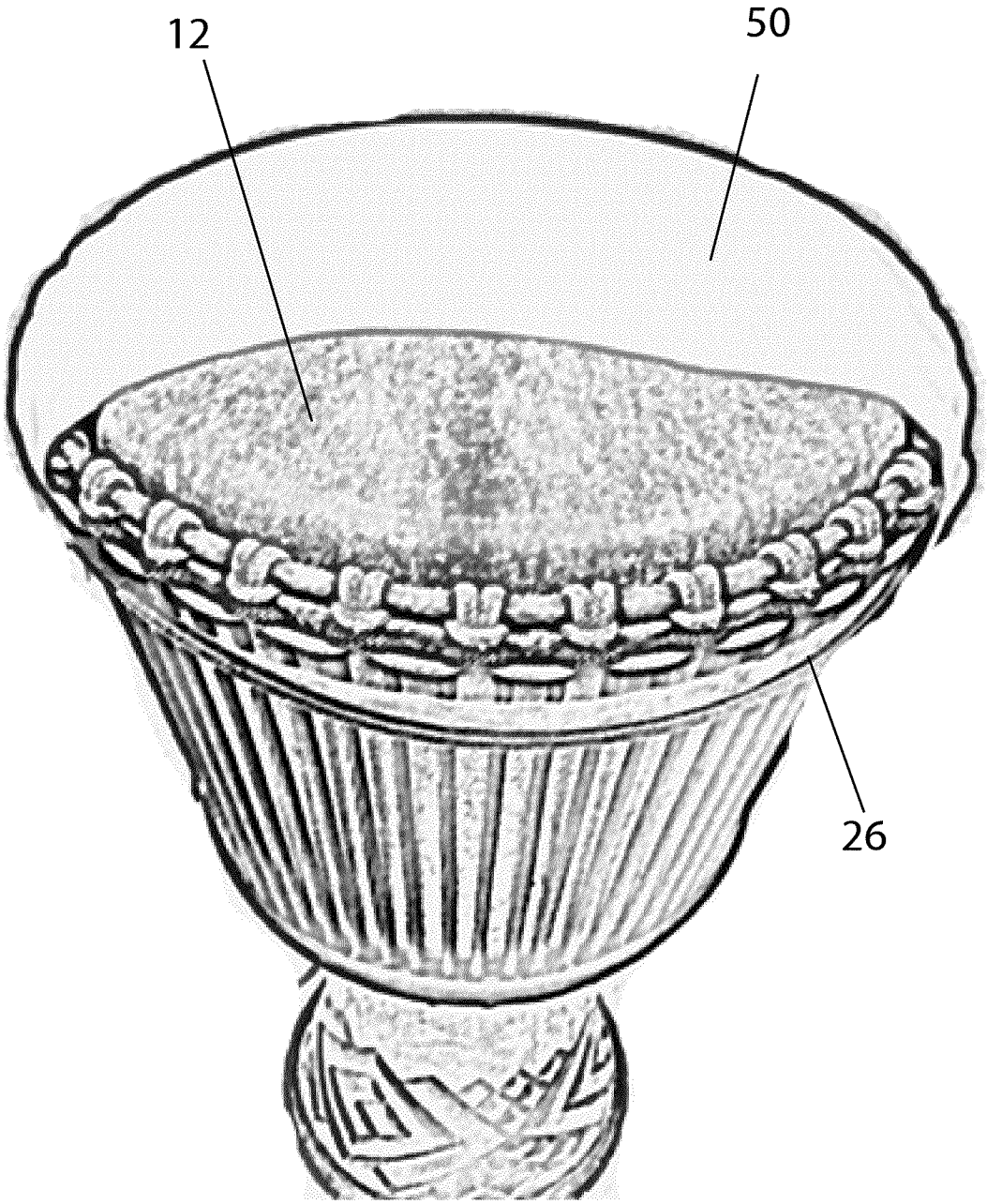
FIG. 5 is a fifth embodiment of a system according to the present invention, utilizing a partial tonal cover.

A partial tonal cover 50 may cover a portion of the drum head (FIG. 5), the entire drum head and a portion, or even all, of the drum body. When partially covering the drum head 12, the player gains the ability to play the same instrument with two different tones. This can be particularly effective if the tonal covers could be easily removed during play, even to a partial degree, as different tonal effects may be generated by this variable coverage caused by rapid placement and removal, or partial removal, of tonal covers.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A tonal cover for a membranophone, the membranophone comprising a drum head and a resonation chamber, the tonal cover comprising:

a. a membrane distinct from the drum head;

b. a plurality of grommets positioned about an edge of the membrane; and c. a securement cord threaded through the grommets;

wherein use of the tonal cover alters a natural pitch of the membranophone to an alternate pitch when the membranophone is played.

2. A system for the tonal adjustment of a membranophone, the membranophone comprising a drum head and a resonation chamber, the system comprising:

a. at least one membranous tonal cover;

b. at least one additional membranous tuning layer;

wherein at least one tuning layer is positioned upon the drum head and at least one tonal cover is layered on top of the tuning layer and secured about the resonation chamber of the membranophone for the purpose of altering a natural pitch of the membranophone to a desired pitch.

3. The system of claim 2, at least one tonal cover and at least one tuning layer being a membrane selected from the set of membranes consisting of animal skin, vinyl and rubber.

4. The system of claim 2, the tonal cover further comprising a plurality of grommets positioned about an edge of the tonal cover and a securement drawstring threaded through the grommets.

5. The system of claim 2, the tonal cover further comprising at least one strip fashioned about an edge of the tonal cover such that two or more strips may be tied together to fasten the tonal cover to the membranophone.

6. The system of claim 2, further comprising an elastic band positioned about the resonation chamber to provide friction in an effort to further secure the tonal cover to the membranophone.

7. The system of claim 2, the tonal cover partially covering the drum head.

8. The system of claim 2, the tonal cover variably covering the drum head.

9. A tonal cover for a membranophone, the membranophone comprising a drum head and a resonation chamber, the tonal cover comprising:

a. a membrane distinct from the drum head;

b. means for securing the tonal cover over the membranophone;

wherein use of the tonal cover alters a natural pitch of the membranophone to an alternate pitch when the membranophone is played.

10. The tonal cover of claim 9, the means for securing the tonal cover over the membranophone comprising a plurality of grommets positioned about an edge of the tonal cover and a securement drawstring threaded through the grommets.

11. The tonal cover of claim 9, the means for securing the tonal cover over the membranophone further comprising at least one strip fashioned about an edge of the tonal cover such that two or more strips may be tied together to fasten the tonal cover to the membranophone.

12. The system of claim 9, the means for securing the tonal cover the membranophone comprising an elastic band positioned about the resonation chamber to provide friction in an effort to further secure the tonal cover to the membranophone.

13. The system of claim 9, the tonal cover only partially covering the drum head of the membranophone.

14. The system of claim 9, the tonal cover variably covering the drum head of the membranophone.

* * * * *